US006016051A

United States Patent [19]

Can

[11] Patent Number: 6,016,051

[45] Date of Patent: Jan. 18, 2000

[54] BANDGAP REFERENCE VOLTAGE CIRCUIT WITH PTAT CURRENT SOURCE

[75] Inventor: Sümer Can, Cupertino, Calif.

[73] Assignee: National Semiconductor Corporation, Santa Clara, Calif.

[21] Appl. No.: 09/163,806

[22] Filed: Sep. 30, 1998

[51] Int. Cl.[7] ..... G05F 3/16

[52] U.S. Cl. ..... 323/315; 323/316; 323/314; 323/907

[58] Field of Search ..... 323/315, 316, 323/907, 314; 327/539

[56] References Cited

U.S. PATENT DOCUMENTS

| | | | |
|---|---|---|---|
| 4,165,642 | 8/1979 | Lipp | 73/362 |
| 4,603,291 | 7/1986 | Nelson | 323/315 |
| 5,434,534 | 7/1995 | Lucas | 327/546 |
| 5,444,219 | 8/1995 | Kelly | 219/505 |
| 5,646,518 | 7/1997 | Lakshmikumar et al. | 323/316 |

OTHER PUBLICATIONS

Vittoz, Eric, "The Design of High–Performance Analog Circuits On Digital CMOS Chips", *IEEE Journal of Solid–State Circuits,* Jun. 1985, vol. SC–20, No. 3, pp. 657–665.

Vittoz, Eric, et al., "CMOS Analog Integrated Circuits Based On Weak Inversion Operation", *IEEE Journal of Solid–State Circuits,* Jun. 1977, vol. SC–12, No. 3, pp. 224–231.

Fisher, Aaron, et al., "A 50–Mbit/s CMOS Optical Transmitter Integrated Circuit", *IEEE Journal of Solid–State Circuits,* Dec. 1986, vol. SC–21, No. 6, pp. 901–908.

*Primary Examiner*—Shawn Riley

*Attorney, Agent, or Firm*—Limbach & Limbach L.L.P.

[57] ABSTRACT

A bandgap reference circuit capable of operating at low voltage provides an adjustable bandgap reference voltage. The bandgap reference circuit includes a proportional to absolute temperature (PTAT) current source, a bias current source, two resistors and a transistor. The base of the transistor couples to the IPTAT current source and the emitter of the transistor couples to the bias current source. The bandgap reference circuit also includes two resistors. The first resistor couples between the emitter and the base of the transistor, and the second resistor couples to the base of the transistor. The first resistor receives a portion of the bias current and provides a current proportional to a base-emitter voltage of the transistor. The second resistor receives the PTAT current and the current proportional to the base-emitter voltage of the transistor and provides a reference voltage which remains substantially constant over temperature and which is proportional to a silicon bandgap voltage. The ratio of the first and second resistors determines the proportionality of the reference voltage to the silicon bandgap voltage. Thus, by adjusting the ratio of the two resistors a reference voltage less than the silicon bandgap voltage can be obtained.

24 Claims, 2 Drawing Sheets

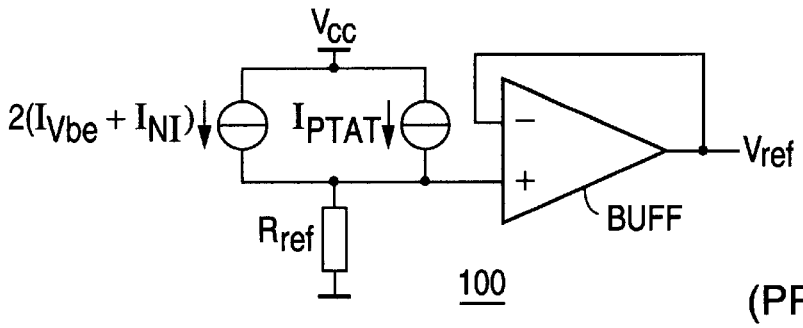
FIG. 1
(PRIOR ART)
FIG. 2
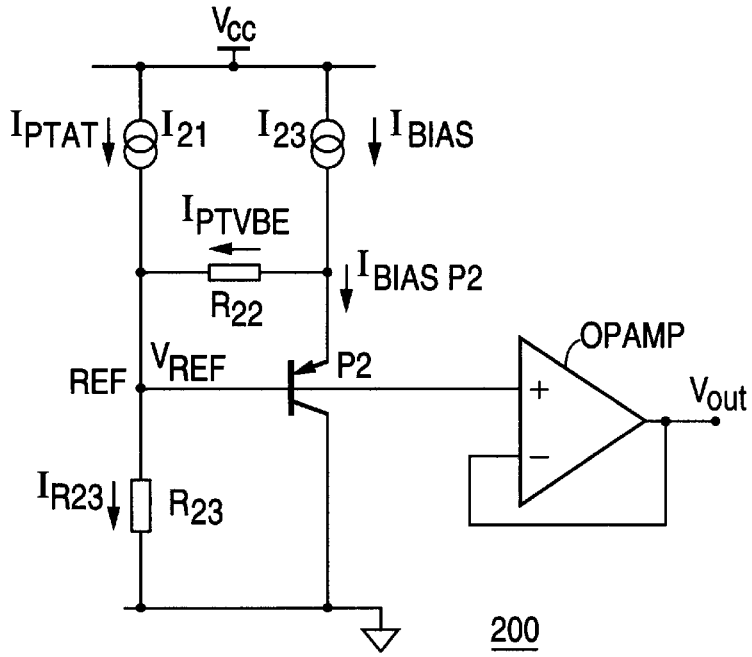
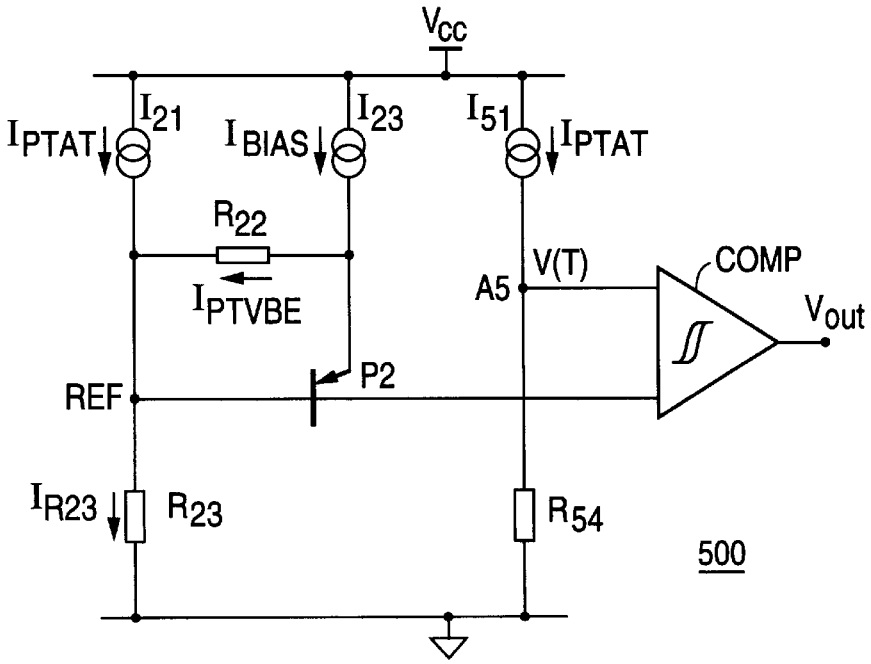
FIG. 5

BANDGAP REFERENCE VOLTAGE CIRCUIT WITH PTAT CURRENT SOURCE

BACKGROUND OF THE INVENTION

1. Field of the Invention

The present invention relates to integrated circuits (ICs) and reference circuits, and in particular, to a bandgap reference voltage circuit.

2. Description of the Related Art

In the design of large-scale integrated circuits, it is often necessary to provide a local reference voltage of a known value that remains stable with both temperature and process variations. A common prior art solution is a bandgap reference circuit. A bandgap reference circuit provides stable, precise and continuous output reference voltages for use in various analog circuits. Recently, it has become necessary for many commercial integrated circuits to operate at less than the conventional five-volt power supply voltage, such as three volts. As a result, bandgap reference voltage circuits must operate over a power supply range from over five volts down to three volts and less. The output reference voltage provided by known bandgap reference circuits, however, typically varies somewhat with respect to one or more of factors, such as temperature and manufacturing processes. Some known bandgap reference circuits fail to function when the power supply voltage is lowered to three volts.

One method of providing a voltage reference is to provide a stable reference current through a precision resistor. The base-emitter voltage VBE of a forward-biased bipolar transistor is a fairly linear function of absolute temperature T in degrees Kelvin (°K), and is known to provide a stable and relatively linear temperature sensor. In a bandgap reference, the reference voltage is obtained by compensating the base-emitter voltage of a bipolar transistor VBE for its temperature dependence (which is inversely proportional to temperature) using a proportional to absolute temperature (PTAT) voltage. The difference known as "delta VBE" or "ΔVBE" between the base-emitter voltages VBE1 and VBE2 of two transistors that are operated at a constant ratio between their emitter-current densities forms the PTAT voltage. The emitter-current density is conventionally defined as the ratio of the collector current to the emitter size. Thus, the basic PTAT voltage ΔVBE is given by:

$$\Delta VBE = VBE1 - VBE2 \tag{1}$$

$$\Delta VBE = \frac{kT}{q} * \ln\left(\frac{J1}{J2}\right) \tag{2}$$

where k is Boltzmann's constant, T is the absolute temperature in degree (Kelvin), q is the electron charge, J1 is the current density of a transistor T1, and J2 is the current density of a transistor T2. As a result, when two silicon junctions are operated at different current densities (J1, J2), the differential voltage ΔVBE is a predictable, accurate and linear function of temperature.

One conventional low-voltage bipolar bandgap reference having curvature correction is capable of operating when the power supply voltage is lowered to less than three volts. Such low-voltage bandgap reference is described in Gunawan et al., *A Curvature-Corrected Low- Voltage Bandgap Reference*, IEEE Journal of Solid-State Circuits, Vol. 28, No. 6, June 1983, pp. 667–670, incorporated herein by reference and illustrated in FIG. 1. In low voltage bandgap reference circuit 100, a current proportional to VBE (2IVBE) and a nonlinear correction current (2INL) are generated. When the nonlinear (curvature) correction is performed correctly, 2(IVBE+INL) should consist of a constant component and a component that is proportional to absolute temperature (PTAT). This latter component can be compensated by using a PTAT current source. The sum of the currents is converted into the voltage reference VREF by using a resistor Rref. A buffer circuit BUFF is applied to obtain a sufficiently low output impedance. With such a configuration, the low-voltage reference VREF has the typical attractive feature of bandgap references that the output voltage is temperature-independent when this voltage is adjusted for a predetermined value. The minimum supply voltage is 1 V for an operating temperature range from 0° C. to 125° C. The circuit also operates at temperatures lower than 0° C., but then a slightly higher supply voltage has to be tolerated.

Although this conventional low-voltage bandgap reference circuit 100 can operate at low supply voltages, the circuit 100 only operates with bipolar technology. Thus, a need exists for a bandgap reference circuit that can operate at low supply voltages, uses an adjustable reference voltage, and is not limited to operation in bipolar technology.

SUMMARY OF THE INVENTION

A bandgap reference circuit in accordance with one embodiment of the present invention is capable of operating on a wide range of supply voltage to provide an adjustable reference voltage, and is not limited to operation in bipolar technology. Such bandgap reference circuit includes and a transistor, and a proportional to absolute temperature (PTAT) current source and a bias current source that generate a PTAT current and a bias current, respectively. The base of the transistor couples to the PTAT current source and the emitter of the transistor couples to the bias current source. The bandgap reference circuit also includes two resistors. The first resistor couples between the emitter and the base of the transistor, and the second resistor couples to the base of the transistor.

The first resistor receives a portion of the bias current and provides a current proportional to a base-emitter voltage of the transistor. The second resistor receives the PTAT current and the current proportional to the base-emitter voltage of the transistor and provides a reference voltage which remains substantially constant over temperature and which is proportional to a silicon bandgap voltage. The ratio of the first and second resistors determines the proportionality of the reference voltage to the silicon bandgap voltage. Thus, by adjusting the ratio of the two resistors a reference voltage less than the silicon bandgap voltage can be obtained.

A bandgap reference circuit in accordance with another embodiment of the present invention includes a buffer circuit to buffer the reference voltage.

A bandgap reference circuit in accordance with still another embodiment of the present invention is used as an adjustable thermostat. Such adjustable thermostat includes two proportional to absolute temperature (PTAT) current sources that generate first and second PTAT currents, respectively, a bias current source that generates a bias current, and a transistor. The base of the transistor couples to the first PTAT current source and the emitter couples to the bias current source. The adjustable thermostat also includes three resistors and a comparator. The first resistor couples between the emitter and the base of the transistor and to the first PTAT current source, the second resistor couples to the base of the transistor, and the third resistor couples to the second PTAT current source. The comparator couples to the second PTAT current source and to the base of the transistor.

The first resistor receives a portion of the bias current and provides a current proportional to a base-emitter voltage of the transistor. The second resistor receives the PTAT current and the current proportional to the base-emitter voltage of the transistor and provides a reference voltage which remains substantially constant over temperature and which is proportional to a silicon bandgap voltage. The third resistor receives the second PTAT current and provides a voltage signal proportional to temperature. The comparator then compares the voltage signal proportional to temperature with the reference voltage and changes an output signal state when the voltage proportional to temperature transcends the reference voltage. Thus, from the change in the comparator output signal state, it can be determined when voltage proportional to temperature has transcended the reference voltage.

In addition, the ratio of the first and second resistors determines the proportionality of the reference voltage to the silicon bandgap voltage. Thus, by adjusting the ratio of the two resistors a reference voltage less than the silicon bandgap voltage can be obtained.

These and other features and advantages of the present invention will be understood upon consideration of the following detailed description of the invention and the accompanying drawings.

BRIEF DESCRIPTION OF THE DRAWINGS

FIG. 1 illustrates a schematic diagram of a conventional bandgap reference circuit.

FIG. 2 is a schematic diagram of a bandgap reference circuit in accordance with a first embodiment of the present invention.

FIG. 5. is a schematic diagram of the bandgap reference circuit in accordance with a fourth embodiment of the present invention.

Like reference symbols are employed in the drawings and in the description of the preferred embodiment to represent the same or similar items.

DESCRIPTION OF THE PREFERRED EMBODIMENT

Figure 3:
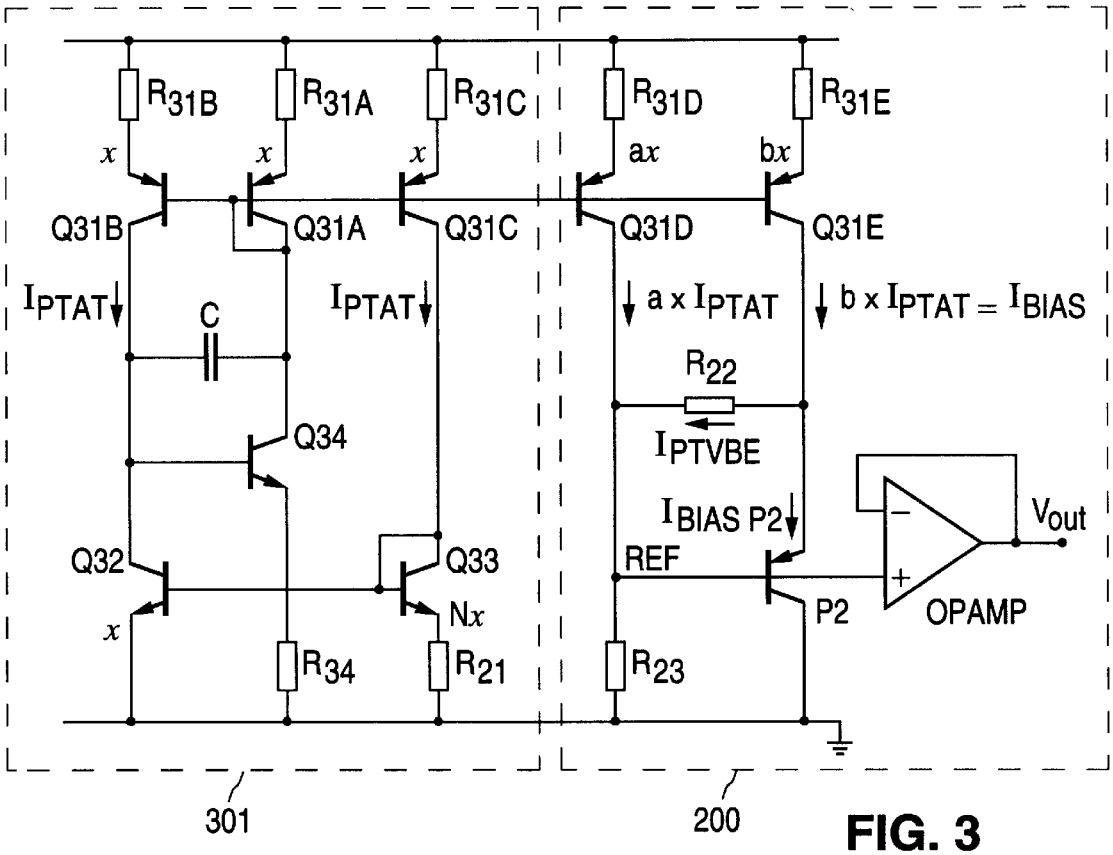
FIG. 3 is a schematic diagram of the bandgap reference circuit in accordance with a second embodiment of the present invention.

A schematic diagram of a bandgap reference circuit 200 in accordance with a first embodiment of the present invention is illustrated in FIG. 2. In this embodiment, bandgap reference circuit 200 outputs an adjustable voltage reference VREF, and includes two current sources I21 and I23, two resistors R22, R23 and a P-type transistor P2. Although a P-type transistor P2 is illustrated in FIG. 2, it will be appreciated that an N-type transistor can also be used.

The circuit shown in FIG. 2 is suitable for realization using bipolar as well as complementary metal oxide semiconductor (CMOS) technologies. In case of bipolar technology, both an NPN or a PNP transistor can be utilized. In case of CMOS technology, a substrate PNP or a substrate NPN should be utilized for n-well and p-well CMOS technologies, respectively. For the n-well technology, which is the preferred CMOS technology in industry, the PNP transistor is formed by P+ diffusion inside the n-well and the p-type substrate. The P+ diffusion forms the emitter, the n-well forms the base and the p-type substrate forms the collector. Note that in these bipolar transistor structures that exist inherently in CMOS technologies, the collectors are not available as a separate terminal since they are formed by the common substrate, which is p-type for n-well CMOS and n-type for p-well CMOS technology.

Referring again to FIG. 2, the base of transistor P2 couples to reference node. The collector of the transistor P2 is within the substrate and the emitter couples to current source I23. Resistor R22 couples between the base and emitter of transistor P2, and resistor R23 couples between reference node REF and circuit ground. Both current sources I21 and I23 couple to power supply VCC.

In operation, current source I21 provides a first reference current, which in the exemplary embodiment illustrated in FIG. 2, is a current proportional to absolute temperature (IPTAT). This reference current IPTAT is equal to a difference ΔVBE between base-emitter voltages VBE1 and VBE2 of a pair of transistors (not shown), also known as voltage proportional to absolute temperature (VPTAT), divided by a resistor R21 (not shown). Current source I23 provides a bias current IBIAS large enough to provide a current to resistor R22 and a bias current IBIASP2 to transistor P2. The current provided to resistor R22 is a current proportional to the base-emitter voltage of transistor P2 (IPTVBE). In the exemplary embodiment illustrated, current IBIAS is a multiple (k) of current IPTAT.

With this circuit configuration, the voltage VREF at node RFF is equal to:

$$\text{VREF}=IR23 * R23 \tag{4}$$

where IR23 is the current through resistor R23 and is equal to:

$$IR23 = IPTAT + IPTVBE \tag{5}$$

or, $$IR23 = \frac{VPTAT}{R21} + \frac{VBE}{R22} \tag{6}$$

where VBE is the base-emitter voltage of transistor P2. Thus, $$VREF = \left(\frac{VPTAT}{R21} + \frac{VBE}{R22}\right)R23 \tag{7}$$

Equation (7) can be re-arranged as;

$$VREF = \frac{R23}{R22}\left(VBE + \frac{R22}{R21}VPTAT\right) \tag{8}$$

By choosing the resistor ratio R22/R21 as;

$$\frac{R22}{R21} = \frac{Vbg - VBE(To)}{VPTAT(To)} \tag{9}$$

where Vbg is a bandgap voltage, such as the silicon bandgap voltage, yields;

$$Vbg = VBE + \frac{R22}{R21} VPTAT \tag{10}$$

Thus, $$VREF = \frac{R23}{R22} Vbg \tag{11}$$

Typically, bandgap voltage Vbg is a fixed value, such as 1.2 volts. The base-emitter voltage VBE of transistor P2 and voltage VPTAT are also fixed values, although VBE is process dependent. In an exemplary embodiment, base-emitter voltage VBE and voltage VPTAT may be approximately 600 mV and 60 mV, respectively. Resistors R22 and R21 are then trimmed to ensure equation (9) is satisfied. For example, the ratio of resistor R22 to resistor R21 may also be set equal to a desired value, such as 10, to reflect the desired value of voltage VPTAT for a known bandgap voltage Vbg and base-emitter voltage VBE.

When equation (9) is satisfied, then voltage VREF at node REF is equal to:

$$VREF = \frac{R23}{R22} Vbg \tag{11}$$

As can be seen from this equation (11), by adjusting the ratio of resistors R23/R22, reference voltage VREF can be adjusted larger or smaller than bandgap voltage Vbg. In particular, when the ratio of resistors R23/R22 is less than 1, a sub-bandgap reference voltage VREF can be generated by bandgap reference circuit 200. This makes bandgap reference circuit 200 particularly advantageous for low voltage operation where its operation as a sub-bandgap voltage reference may be desirable.

In one embodiment, bandgap reference circuit 200 includes an operational amplifier OPAMP, as illustrated in FIG. 2. As shown, the base of transistor P2 couples to the non-inverting input of operational amplifier OPAMP. The inverting input of operational amplifier OPAMP is coupled to the output of the operational amplifier OPAMP to provide feedback. The reference voltage VREF at node REF is supplied to the non-inverting input of operational amplifier OPAMP which buffers node REF from any significant current draw when reference voltage VREF is driving a load. Thus, the output voltage Vout from operational amplifier OPAMP provides a relatively stable bandgap reference voltage Vout which can be employed as a bandgap reference voltage for many different circuits or devices.

One advantage of bandgap reference circuit 200 is its suitability for both bipolar and CMOS technologies. A more detailed explanation of the operation of bandgap reference circuit 200 is provided with respect to FIG. 3 with bandgap reference circuit 200 operating with bipolar technology.

In this embodiment of bandgap reference circuit 200, current source 301 comprises bipolar transistors to provide the reference current. It will be appreciated that current source I21 illustrated in FIG. 2 is represented by transistor Q31D and current source I23 illustrated in FIG. 2 is represented by transistor Q31E.

Current source 301 provides a reference current IPTAT which is stable with respect to changes in temperature and power supply voltage. Providing a basic PTAT voltage ΔVBE across a known resistor R21 generates this reference current IPTAT. Since the basic PTAT voltage ΔVBE represents the difference between the base-emitter voltages of two transistors, the voltage ΔVBE is relatively insensitive to variations in the power supply voltage and to manufacturing process variations. Current source 301 also mirrors current to provide a bias current IBIAS.

Referring now to current source 301, transistors Q31B–Q31E function as current sources mirroring the current fed into transistor Q31A. Transistors Q31A–Q31C and Q32–Q34 set up the current IPTAT source. Transistors Q31B and Q31C have their collectors low and approximately equal voltages, so that their currents will match well. Transistors Q32 and Q33 have low and approximately equal collector-emitter voltage VCE, so that these transistors Q32, Q33 also match well. Transistor Q34 is a gain stage, so its collector-emitter voltage VCE does not have to match those of transistors Q32, Q33. Resistor R34 and capacitor C provide the stability of the circuit. Resistors R31A–R31E are the emitter degeneration resistors. These resistors R31A–R31E help to improve the output resistance of transistors Q31B–Q31E and also provide good matching.

Transistors Q32 and Q33 operate at different current densities to establish the basic PTAT voltage ΔVBE. In the exemplary embodiment illustrated in FIG. 3, transistor Q32 has x emitter(s) and transistor Q33 has N*x emitters and both transistors Q32, Q33 operate at the same current IPTAT from transistors Q31B and Q31C, respectively. Therefore, transistor Q33 has a lower base-emitter voltage VBE than that of transistor Q32. As described in equations (1) and (2) above, the basic PTAT voltage ΔVBE=(kT/q)* ln(J2/J1)= (kT/q) ln N. This voltage difference ΔVBE is impressed on resistor R21 which sets the current through transistor Q33.

Referring now to bandgap reference circuit 200, this circuit 200 includes transistors Q31D, Q31E and P2. Transistor Q31D supplies a multiple (a) of current IPTAT. For example, in one embodiment, the multiple (a) has a value of 1. In such example, $$IPTAT = \frac{VPTAT}{R21} \tag{12}$$

where VPTAT is voltage proportional to absolute temperature as expressed below in equation (13):

$$VPTAT = V_{To} \frac{T}{To} \ln N \tag{13}$$

where $V_{To}$ is the thermal voltage at room temperature, To is room temperature, T is the absolute temperature, and N is the ratio of the current density of transistor Q33 to the current density of transistor Q32. Setting T equal to To and substituting equation (13) into equation (12):

$$IPTAT = \frac{V_{To}}{R21} \ln N \tag{14}$$

Transistor Q31E provides a different multiple (b) of current IPTAT. This is bias current IBIAS, and should be large enough so that a current proportional to the base-emitter voltage of transistor P2 (IPTVBE) is provided to resistor R22, and a bias IBIASP2 current to transistor P2. Current IPTVBE is expressed as:

$$IPTVBE = \frac{VBE}{R22} \tag{15}$$

where VBE is a base-emitter voltage of transistor P2. Since current IR23 through resistor R22 is equal to:

$$IR23 = IPTAT + IPTVBE \tag{5}$$

using equations (5), (14) and (15), current IR23 can be expressed as:

$$IR23 = a * \frac{VPTAT}{R21} + \frac{VBE}{R22} \tag{16}$$

Therefore, reference voltage VREF at node REF can be expressed as:

$$VREF = R23 * IR23 = R23\left(a * \frac{VPTAT}{R21} + \frac{VBE}{R22}\right) \tag{17}$$

$$VREF = \frac{R23}{R22}\left(a * \frac{R22}{R21} VPTAT + VBE\right) \tag{18}$$

The values of resistors R21 and R22 are set such that the following equation is satisfied:

$$\frac{R22}{R21} = \frac{Vbg - VBE(To)}{a * VPTAT(To)} \tag{9}$$

where Vbg is the bandgap voltage, and VBE (To) and VPTAT (To) are the base-emitter voltage VBE and the PTAT voltage at room temperature, respectively. When equation (17) is satisfied, the term in the parenthesis in equation 18 is equal to the bandgap voltage Vbg.

$$VREF = \frac{R23}{R22} Vbg \tag{11}$$

As can be seen from equation (11)

$$\text{when } \frac{R23}{R22} > 1 \quad \text{then } VREF > Vbg \tag{19}$$

$$\text{when } \frac{R23}{R22} = 1 \quad \text{then } VREF = Vbg \tag{20}$$

$$\text{when } \frac{R23}{R22} < 1 \quad \text{then } VREF < Vbg \tag{21}$$

Thus, when R23/R22 is less than 1, a sub-bandgap reference voltage is provided by bandgap reference circuit 200. This reference voltage VREF is then provided to operational amplifier OPAMP which functions as a buffer to obtain a sufficiently low impedance output.

Figure 4:
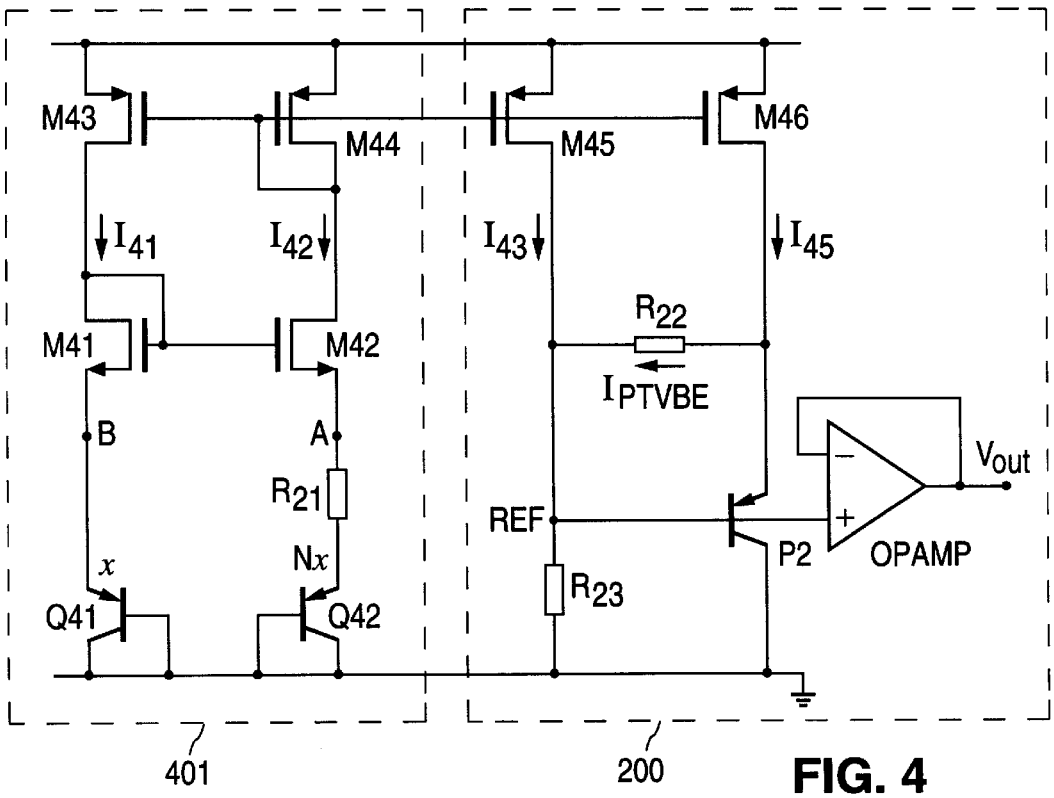
FIG. 4 is a schematic diagram of the bandgap reference circuit in accordance with a third embodiment of the present invention.

Another detailed explanation of the operation of bandgap reference circuit 200 is provided with respect to FIG. 4 where bandgap reference circuit 200 is realized in CMOS technology. In this embodiment a CMOS current source, such as that described in Fisher et al., *Optical Transmitter Integrated Circuit, IEEE Journal of Solid-State Circuits*, Vol. SC-21, No. 6, December 1986, is illustrated by current source 401 in FIG. 4. It will be appreciated that current source 401 is an exemplary CMOS current source, other types of current source circuits that provide reference currents may be used.

Current source 401 has a schematic based on a bipolar thermal voltage reference and provides reference current IPTAT and bias current IBIAS. It will be appreciated that current source I21 illustrated in FIG. 2 is represented by transistor M45, and current source I23 illustrated in FIG. 2 is represented by transistor M46. The bottom current mirror including N-channel transistors M41 and M42 utilizes substrate PNP transistors Q41 and Q42 connected as diodes. Transistors M41, M42 force the voltages at nodes A and B to be equal causing a logarithmic relationship between 141 and 142 as given below:

$$I42 * R21 = V_T \ln\left(\frac{I41 * IS42}{I42 * IS41}\right) \tag{22}$$

where IS41 and IS42 are the saturation currents of transistors Q41 and Q42, respectively, and $V_T$=kT/q.

The top current mirror includes N-channel transistor M43 and M44, and sets:

$$I41 = I42 \tag{23}$$

Solving equations (22) and (23) yields:

$$I41 = I42 = \frac{kT}{qR21} \ln(m) \tag{24}$$

where m=IS42/IS41. Therefore, currents 141 and 142 are PTAT currents. By taking advantage of the wide range of geometrical shape factor S of the transistor, where S is the effective width over the effective length of the channel, transistors M45 and M46 can be sized so that:

$$I43 = a * IPTAT \tag{25}$$

and $$I45 = b * IPTAT \tag{26}$$

Using the same equations (12)–(18), $$VREF = \frac{R23}{R22} Vbg \tag{11}$$

Thus, when the resistor ratio R23/R22 is less than 1, a sub-bandgap reference voltage can be generated by bandgap reference circuit 200. In this way, bandgap reference circuit 200 can be used in CMOS technology.

In yet another embodiment of the present invention, a bandgap reference circuit 500 is used as an adjustable CMOS thermostat, as illustrated in FIG. 5. As shown, bandgap reference 500 includes current sources I21, I23, and I51; P-type transistor P2, resistors R22, R23 and R54 and comparator COMP. Current sources I21 and 151 provide current IPTAT, while current source 122 provides current IBIAS. A reference current source, such as current source 301 illustrated in FIG. 3 for bipolar realization, or current source 401 illustrated in FIG. 4 for CMOS realization, may be used to generate the currents IPTAT and IBIAS.

As stated above with respect to the discussion of bandgap reference circuit 200 illustrated in FIGS. 3 and 4, the current IBIAS should be large enough to provide a current proportional to the base-emitter voltage of transistor P2 (IPTVBE) to resistor R22, and bias current IBIASP2 to transistor P2.

Bandgap reference circuit 500 operates as follows. Current source 151 provides current IPTAT to resistor R54 and generates a voltage proportional to temperature V(T) at node A5, one of the inputs to comparator COMP. In an exemplary embodiment voltage V(T) is proportional to absolute temperature (VPTAT). Similarly, current source I21 provides current IPTAT to generate a voltage reference VREF at reference node REF. Voltage reference VREF, as calculated above in equations (12)–(17) is equal to:

$$VREF = \frac{R23}{R22}\left(a * \frac{R22}{R21} VPTAT + VBE\right) \tag{18}$$

When the following equation is satisfied:

$$\frac{R22}{R21} = \frac{Vbg - VBE(To)}{VPTAT(To)} \tag{9}$$

where Vbg is the bandgap voltage, VBE(To) and VPTAT (To) are the base-emitter voltage and the voltage proportional to absolute temperature at a particular temperature, typically room temperature, respectively, equation (18) can be simplified to the familiar equation (11):

$$VREF = \frac{R23}{R22} Vbg \tag{11}$$

Thus, again by adjusting the ratio of resistor R23 to resistor R22, reference voltage VRFF can be larger or smaller than bandgap voltage Vbg.

Now, solving for voltage proportional to temperature V(T) at node A5 yields:

$$V(T) = \frac{R54}{R21} VPTAT = \left[\frac{R54}{R21} VTo \ln N\right]\frac{T}{To} = \frac{R54}{R21} VPTAT(To)\frac{T}{To} \tag{27}$$

where N is a ratio of the current density of the pair of transistors used to provide the current IPTAT, T is the absolute temperature, and T/To may be called normalized temp.

Now, the switching temperature Tsw, the temperature at which the output of comparator COMP changes state, can be obtained. This is also the thermostat set point. Substituting $T=T_{sw}$ and solving for V(T)=VREF using equations (11) and (27), yields;

$$V(T) = VREF = \frac{R54}{R21} VPTAT(To)\frac{Tsw}{To} \tag{28}$$

then, $$\frac{Tsw}{To} = \frac{VREF}{\frac{R54}{R21} VPTAT(To)} \tag{29}$$

Comparator COMP compares reference voltage VREF, the voltage at node RFF, with voltage proportional to temperature V(T). Comparator COMP outputs a signal having a first state when voltage proportional to temperature V(T) is less than reference voltage VREF, and the output signal stays at this signal state until voltage proportional to temperature V(T) becomes less than reference voltage VREF. For example, comparator COMP outputs "1" state when V(T)<VREF, and continues to output this signal state until V(T)=VREF. At this point, the signal state of the output signal changes to "0" state. Similarly, when voltage proportional to temperature V(T) is greater than voltage reference VREF, comparator COMP outputs a "0" state, and continues to output this signal state until V(T)=VREF. Then, the signal state of the output signal of comparator COMP changes to "1" state. From the change in signal state, it can be determined when voltage proportional to temperature has reached or transcended reference voltage VREF. The temperature at which comparator COMP switches output states, the switching temperature Tsw, is when the voltage proportional to absolute temperature VPTAT will be equal to the reference voltage VREF.

Various other modifications and alterations in the structure and method of operation of this invention will be apparent to those skilled in the art without departing from the scope and spirit of the invention. Although the invention has been described in connection with specific preferred embodiments, it should be understood that the invention as claimed should not be unduly limited to such specific embodiments. It is intended that the following claims define the scope of the present invention and that structures and methods within the scope of these claims and their equivalents be covered thereby.

What is claimed is:

1. An apparatus including a bandgap reference circuit, the bandgap reference circuit comprising:

a proportional to absolute temperature (PTAT) current source that provides a PTAT current;

a bias current source that provides a bias current;

a transistor having a base, an emitter, and a collector, the base coupled to the IPTAT current source and the emitter coupled to the bias current source;

a first resistive circuit coupled between the emitter and the base of the transistor, the first resistive circuit configured to receive a portion of the bias current and in accordance therewith provide a current proportional to a base-emitter voltage of the transistor; and a second resistive circuit coupled to the base of the transistor and configured to receive the PTAT current and the current proportional to the base-emitter voltage of the transistor and in accordance therewith provide a reference voltage which remains substantially constant over temperature and which is proportional to a silicon bandgap voltage, wherein the proportionality of the reference voltage to the silicon bandgap voltage is determined by a ratio of the first and second resistive circuits.

2. The apparatus of claim 1, wherein the ratio of the first and second resistive circuits is such that the reference voltage is greater than or equal to the silicon bandgap voltage.

3. The apparatus of claim 1, wherein the ratio of the first and second resistive circuits is such that the reference voltage is less than or equal to the silicon bandgap voltage.

4. The apparatus of claim 1, further comprising a buffer circuit coupled to the PTAT current source and the second resistive circuit to buffer the reference voltage.

5. The apparatus of claim 4, wherein the buffer circuit comprises an operational amplifier.

6. An apparatus including an adjustable thermostat circuit comprising:

first and second proportional to absolute temperature (PTAT) current sources that provide first and second PTAT currents, respectively;

a bias current source that provides a bias current;

a transistor having a base, an emitter and a collector, the base coupled to the first PTAT current source and the emitter coupled to the bias current source;

a first resistive circuit coupled between the emitter and base of the transistor, the first resistive circuit configured to receive a portion of the bias current and in accordance therewith provide a current proportional to a base-emitter voltage of the transistor;

a second resistive circuit coupled to the base of the transistor and configured to receive the PTAT current and the current proportional to the base-emitter voltage of the transistor and in accordance therewith provide a reference voltage which remains substantially constant over temperature and which is proportional to a silicon bandgap voltage, a third resistive circuit coupled to the second PTAT current source and configured to receive the second PTAT current and in accordance therewith provide a voltage signal proportional to temperature; and a comparator circuit coupled to the second PTAT current source and to the base of the transistor, wherein the comparator compares the voltage signal proportional to temperature with the reference voltage and changes an output signal state when the voltage proportional to temperature transcends the reference voltage.

7. The apparatus of claim 6, wherein the reference voltage is selected by determining a ratio of the first and second resistive circuits.

8. The apparatus of claim 7, wherein the ratio of the first and second resistive circuits is such that the reference voltage is greater than or equal to the silicon bandgap voltage.

9. The apparatus of claim 7, wherein the ratio of the first and second resistive circuits is such that the reference voltage is less than or equal to the silicon bandgap voltage.

10. The apparatus of claim 6, wherein the bias current is proportional to the first PTAT current.

11. A method of providing a bandgap reference voltage, the method comprising the steps of:

providing a proportional to absolute temperature (PTAT) current;

providing a bias current;

receiving a first portion of the bias current by a transistor having a base, an emitter, and a collector, and in accordance therewith providing a base-emitter voltage;

receiving a second portion of the bias current by a first resistive circuit and in accordance therewith providing a current proportional to the base-emitter voltage;

receiving the PTAT current and the current proportional to the base-emitter current by a second resistive circuit and in accordance therewith providing a reference voltage which remains substantially constant over temperature and which is proportional to a silicon bandgap voltage; and adjusting a ratio of the first and second resistive circuits to select the reference voltage.

12. The method of claim 1, wherein the step adjusting a ratio of the first and second resistive circuits to select the reference voltage comprises adjusting a ratio of the first and second resistive circuits to select the reference voltage to be greater than or equal to the silicon bandgap voltage.

13. The method of claim 1, wherein the step of adjusting a ratio of the first and second resistive circuits to select the reference voltage comprises adjusting a ratio of the first and second resistive circuits to select the reference voltage to be less than or equal to the silicon bandgap voltage.

14. The method of claim 1, further comprising the step of buffering the reference voltage by coupling a buffer circuit to the second resistive circuit.

15. A method of providing an adjustable thermostat, the method comprising the steps of:

providing first and second proportional to absolute temperature (PTAT) currents;

providing a bias current;

receiving a first portion of the bias current by a transistor having a base, an emitter and a collector, and in accordance therewith providing a base-emitter voltage;

receiving a second portion of the bias current by a first resistive circuit and in accordance therewith providing a current proportional to the base-emitter voltage of the transistor;

receiving the PTAT current and the current proportional to the base-emitter voltage of the transistor by a second resistive circuit and in accordance therewith providing a reference voltage which remains substantially constant over temperature and which is proportional to a silicon bandgap voltage, receiving the second PTAT current by a third resistive circuit and in accordance therewith provide a voltage signal proportional to temperature;

comparing the voltage signal proportional to temperature with the reference voltage; and changing an output signal state when the voltage proportional to temperature transcends the reference voltage.

16. The method of claim 15, wherein a proportion of the reference voltage to the silicon bandgap voltage is selected by adjusting a ratio of the first and second resistive circuits.

17. The method of claim 16, wherein the ratio of the first and second resistive circuits is such that the reference voltage is greater than or equal to the silicon bandgap voltage.

18. The method of claim 16, wherein the ratio of the first and second resistive circuits is such that the reference voltage is less than or equal to the silicon bandgap voltage.

19. The method of claim 15, wherein the bias current is proportional to the first PTAT current.

20. An apparatus including a bandgap reference circuit, the bandgap reference circuit comprising:

a proportional to absolute temperature (PTAT) current source that provides a PTAT current;

a bias current source that provides a bias current;

a transistor having a base, an emitter, and a collector, the base connected to the IPTAT current source and the emitter connected to the bias current source;

a first resistive circuit connected to the emitter and the base of the transistor, the first resistive circuit configured to receive a portion of the bias current and in accordance therewith provide a current proportional to a base-emitter voltage of the transistor; and a second resistive circuit connected to the base of the transistor and configured to receive the PTAT current and the current proportional to the base-emitter voltage of the transistor and in accordance therewith provide a reference voltage which remains substantially constant over temperature and which is proportional to a silicon bandgap voltage, wherein the proportionality of the reference voltage to the silicon bandgap voltage is determined by a ratio of the first and second resistive circuits.

21. The apparatus of claim 20, wherein the ratio of the first and second resistive circuits is such that the reference voltage is greater than or equal to the silicon bandgap voltage.

22. The apparatus of claim 20, wherein the ratio of the first and second resistive circuits is such that the reference voltage is less than or equal to the silicon bandgap voltage.

23. The apparatus of claim 20, further comprising a buffer circuit coupled to the PTAT current source and the second resistive circuit to buffer the reference voltage.

24. The apparatus of claim 23, wherein the buffer circuit comprises an operational amplifier.

* * * * *